US008326200B2

(12) United States Patent
Komuro

(10) Patent No.: US 8,326,200 B2
(45) Date of Patent: Dec. 4, 2012

(54) FIXING DEVICE, IMAGE FORMING APPARATUS AND METHOD OF CONTROLLING FIXING DEVICE

(75) Inventor: Hitoshi Komuro, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 449 days.

(21) Appl. No.: 12/621,978

(22) Filed: Nov. 19, 2009

(65) Prior Publication Data

US 2010/0316421 A1 Dec. 16, 2010

(30) Foreign Application Priority Data

Jun. 12, 2009 (JP) ..... 2009-141501

(51) Int. Cl.
*G03G 15/16* (2006.01)
*G03G 15/20* (2006.01)

(52) U.S. Cl. ..... 399/329; 399/122

(58) Field of Classification Search ..... 399/329, 399/21, 122

See application file for complete search history.

(56) References Cited

U.S. PATENT DOCUMENTS

| | | | | |
|---|---|---|---|---|
| 5,666,624 | A | 9/1997 | Kanesawa et al. | |
| 7,392,006 | B2 | 6/2008 | Kameda et al. | |
| 2004/0057759 | A1 * | 3/2004 | Ogiso et al. | 399/329 |
| 2006/0245798 | A1 * | 11/2006 | Nakayama | 399/329 |
| 2007/0059060 | A1 * | 3/2007 | Kameda et al. | 399/329 |
| 2007/0059064 | A1 * | 3/2007 | Okuda et al. | 399/329 |
| 2007/0071522 | A1 * | 3/2007 | Kaji et al. | 399/329 |
| 2007/0231026 | A1 * | 10/2007 | Hayashi et al. | 399/329 |
| 2008/0219725 | A1 * | 9/2008 | Saiki | 399/329 |
| 2008/0219726 | A1 * | 9/2008 | Fukai | 399/329 |
| 2009/0067900 | A1 * | 3/2009 | Yamano | 399/329 |
| 2009/0279929 | A1 * | 11/2009 | Nagase | 399/329 |

FOREIGN PATENT DOCUMENTS

| | | | |
|---|---|---|---|
| JP | A-9-34291 | | 2/1997 |
| JP | A-11-194642 | | 7/1999 |
| JP | 2002372881 | A * | 12/2002 |
| JP | A-2007-79036 | | 3/2007 |
| JP | 2009134161 | A * | 6/2009 |

* cited by examiner

*Primary Examiner* — Walter L Lindsay, Jr.
*Assistant Examiner* — David Bolduc
(74) *Attorney, Agent, or Firm* — Oliff & Berridge, PLC

(57) ABSTRACT

A fixing device includes: a fixing member that fixes a toner image on a recording medium; a fixing pressure member that forms, between the fixing member and the fixing pressure member, a fixing pressure portion for the recording medium holding an unfixed toner image to pass through, by being brought into pressure contact with an outer circumferential surface of the fixing member; a drive unit that rotates the fixing pressure member by rotating the fixing member; and a lubricant adjusting member that comes into contact with an inner circumferential surface of a belt member, at least either the fixing member or the fixing pressure member being the belt member. The lubricant adjusting member is separated from the inner circumferential surface of the belt member, at least while the recording medium and the belt member are in contact with each other and while rotation of the belt member is stopped.

14 Claims, 5 Drawing Sheets

FIXING DEVICE, IMAGE FORMING APPARATUS AND METHOD OF CONTROLLING FIXING DEVICE

CROSS REFERENCE TO RELATED APPLICATIONS

This application is based on and claims priority under 35 USC §119 from Japanese Patent Application No. 2009-141501 filed Jun. 12, 2009.

BACKGROUND

1. Technical Field

The present invention relates to a fixing device, an image forming apparatus and a method of controlling a fixing device.

2. Related Art

An image forming apparatus such as an electrophotographic copier or a printer includes a fixing device that fuses and fixes a resin component of a toner transferred on a recording medium, by applying heat and pressure simultaneously.

SUMMARY

According to an aspect of the present invention, there is provided a fixing device including: a fixing member that fixes a toner image on a recording medium; a fixing pressure member that forms, between the fixing member and the fixing pressure member, a fixing pressure portion for the recording medium holding an unfixed toner image to pass through, by being brought into pressure contact with an outer circumferential surface of the fixing member; a drive unit that rotates the fixing pressure member by rotating the fixing member; and a lubricant adjusting member that comes into contact with an inner circumferential surface of a belt member, at least either the fixing member or the fixing pressure member being the belt member. The lubricant adjusting member is separated from the inner circumferential surface of the belt member, at least while the recording medium and the belt member are in contact with each other and while rotation of the belt member is stopped.

BRIEF DESCRIPTION OF THE DRAWINGS

Exemplary embodiment (s) of the present invention will be described in detail based on the following figures, wherein.

DETAILED DESCRIPTION

An exemplary embodiment of the present invention will be described below in detail with reference to the accompanying drawings.

<Description of Image Forming Apparatus>

Figure 1:
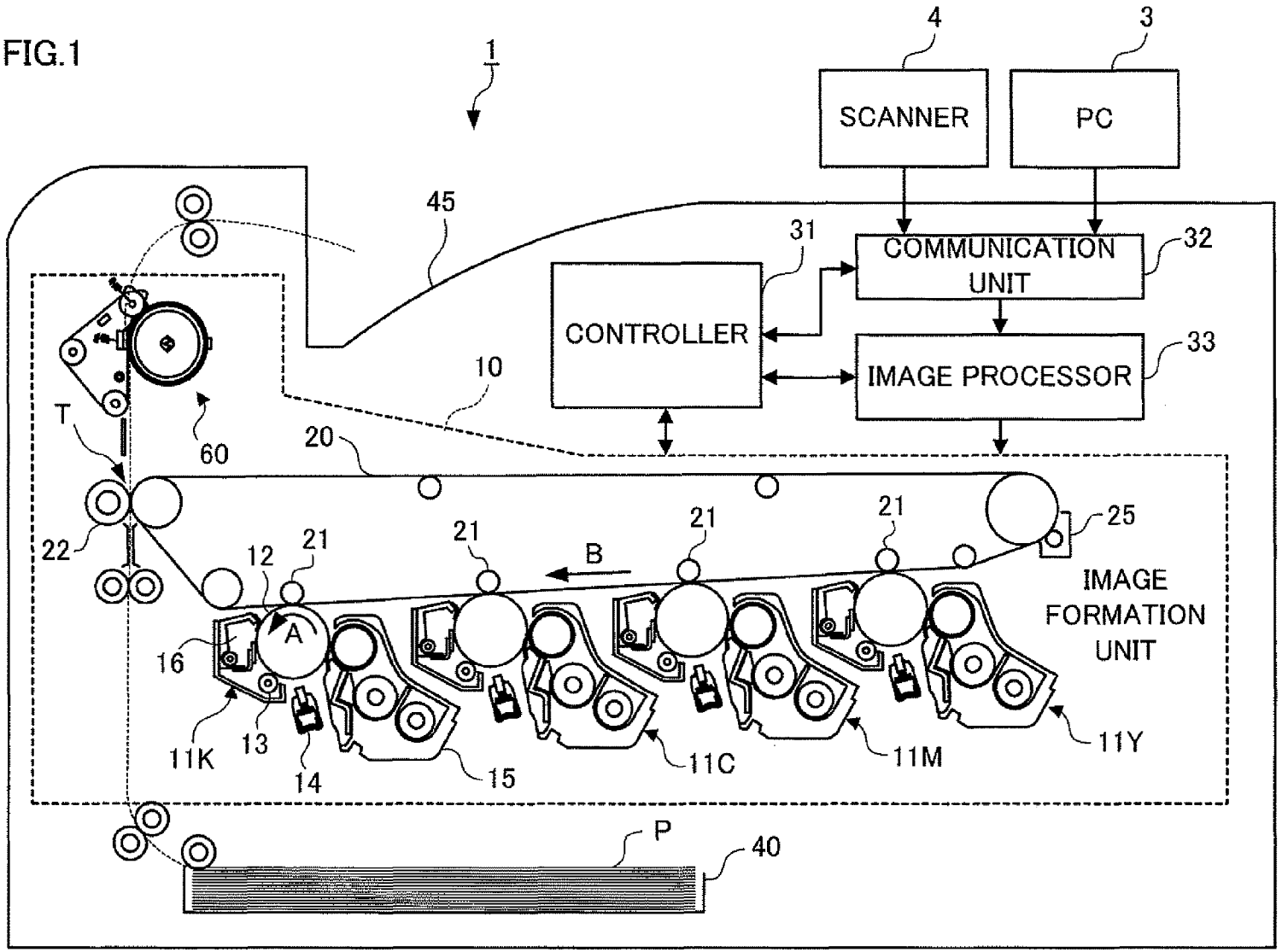
FIG. 1 is a diagram showing a configuration example of an image forming apparatus to which a fixing device of the exemplary embodiments is applied.

FIG. 1 is a diagram showing a configuration example of an image forming apparatus to which a fixing device of the exemplary embodiments is applied. An image forming apparatus 1 shown in FIG. 1 is a so-called tandem-type color printer, and includes: an image formation unit 10 that performs image formation on the basis of image data; and a controller 31 that controls operations of the entire image forming apparatus 1. The image forming apparatus 1 further includes: a communication unit 32 that communicates with, for example, a personal computer (PC) 3, an image reading apparatus (scanner) 4 or the like to receive image data; and an image processor 33 that performs image processing set in advance on image data received by the communication unit 32.

The image formation unit 10 includes four image forming units 11Y, 11M, 11C and 11K (also collectively referred to as an "image forming unit 11") as an example of toner image forming units that are arranged side by side at regular intervals. Each of the image forming units 11 includes: a photoconductive drum 12 as an example of an image carrier that forms an electrostatic latent image and that holds a toner image; a charging device 13 that uniformly charges the surface of the photoconductive drum 12 at a potential set in advance; a light emitting diode (LED) print head 14 that exposes, on the basis of color image data, the photoconductive drum 12 charged by the charging device 13; a developing device 15 that develops the electrostatic latent image formed on the photoconductive drum 12; and a drum cleaner 16 that cleans the surface of the photoconductive drum 12 after transfer.

The image forming units 11 have almost the same configuration except toner contained in the developing device 15, and form yellow (Y), magenta (M), cyan (C) and black (K) color toner images, respectively.

Further, the image formation unit 10 includes: an intermediate transfer belt 20 onto which multiple layers of color toner images formed on the photoconductive drums 12 of the image forming units 11 are transferred; and primary transfer rolls 21 that sequentially transfer (primarily transfer) color toner images formed in the respective image forming units 11 onto the intermediate transfer belt 20. Furthermore, the image formation unit 10 includes: a secondary transfer roll 22 that collectively transfers (secondarily transfers), onto a sheet P that is a recording medium (recording sheet), the color toner images having been superimposingly transferred onto the intermediate transfer belt 20; and a fixing device 60 as an example of a fixing unit (fixing device) that fixes, onto the sheet P, the color toner images having been secondarily transferred. Note that, in the image forming apparatus 1 according to the exemplary embodiments, the intermediate transfer belt 20, the primary transfer rolls 21 and the secondary transfer roll 22 configure a transfer unit.

In the image forming apparatus 1 of the exemplary embodiments, image formation processing using the following processes is performed under operations controlled by the controller 31. Specifically, image data from the PC 3 or the scanner 4 is received by the communication unit 32, and the image data of each color is generated and sent to a corresponding one of the image forming units 11 after the image data is subjected to predetermined image processing performed by the image processor 33. Then, in the image forming unit 11K that forms a black-color (K) toner image, for example, the photoconductive drum 12 is uniformly charged by the charging device 13 at the potential set in advance while rotating in a direction of an arrow A, and then is scanned and exposed by the LED print head 14 on the basis of the K color image data transmitted from the image processor 33. Thereby, an electrostatic latent image for the black-color image is formed on the photoconductive drum 12. The black-color electrostatic latent image formed on the photoconductive drum 12 is developed by the developing device 15. The black-color toner image is then formed on the photoconductive drum 12. In the same manner, yellow (Y), magenta (M) and cyan (C) color toner images are formed in the image forming units 11Y, 11M and 11C, respectively.

The color toner images formed on the respective photoconductive drums 12 in the image forming units 11 are electrostatically transferred (primarily transferred), by the primary transfer rolls 21 in sequence, onto the intermediate transfer belt 20 that moves in a direction of an arrow B. Superimposed toner images on which the color toner images are superimposed on one another are then formed. The superimposed toner images on the intermediate transfer belt 20 are transported to a region (secondary transfer portion T) at which the secondary transfer roll 22 is arranged, along with the movement of the intermediate transfer belt 20. The sheet P is supplied from a sheet holding unit 40 to the secondary transfer portion T at timing when the superimposed toner images being transported arrive at the secondary transfer portion T. Then, the superimposed toner images are collectively and electrostatically transferred (secondarily transferred) onto the transported sheet P by action of a transfer electric field that the secondary transfer roll 22 forms at the secondary transfer portion T.

Thereafter, the sheet P onto which the superimposed toner images are electrostatically transferred is transported toward the fixing device 60. The toner images on the sheet P transported to the fixing device 60 are subjected to heat and pressure (nip pressure) by the fixing device 60 and thereby are fixed onto the sheet P. Then, the sheet P including the fixed images formed thereon is transported to a sheet stacking unit 45 provided at an output portion of the image forming apparatus 1.

Meanwhile, the toner (primary-transfer residual toner) attached to the photoconductive drums 12 after the primary transfer and the toner (secondary-transfer residual toner) attached to the intermediate transfer belt 20 after the secondary transfer are removed by the drum cleaners 16 and a belt cleaner 25, respectively.

In this way, the image formation processing in the image forming apparatus 1 is repeatedly performed for a designated number of print sheets.

<Description of Configuration of Fixing Device>

Next, a description will be given of the fixing device 60 in the exemplary embodiments.

Figure 2:
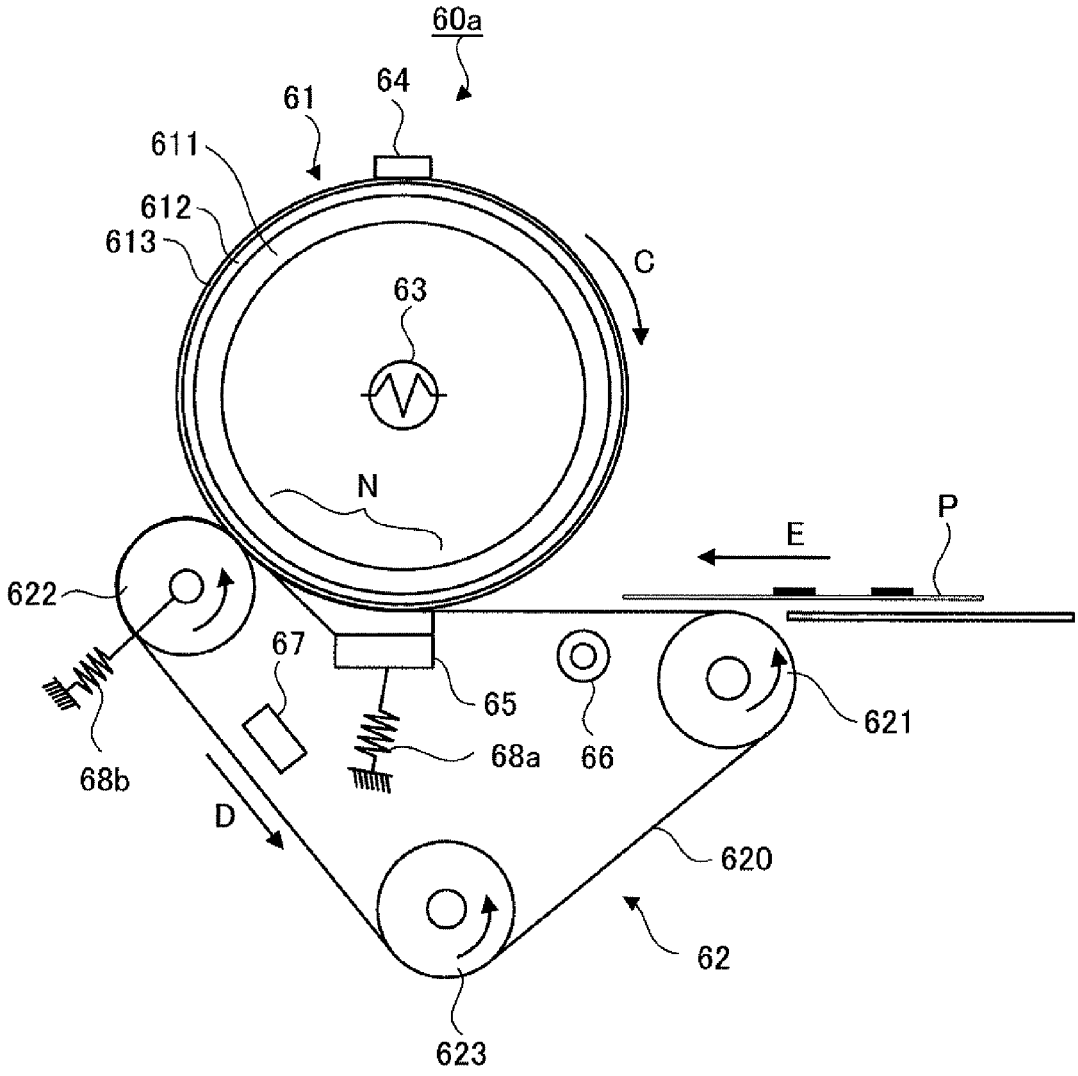
FIG. 2 is a diagram illustrating a first exemplary embodiment of the fixing device in the exemplary embodiments.

FIG. 2 is a diagram illustrating a first exemplary embodiment of the fixing device in the exemplary embodiments.

A fixing device 60*a* shown in FIG. 2 is a first example of the fixing device 60 in FIG. 1, and is a fixing device of a so-called belt nip method. The fixing device 60*a* includes a fixing roll 61 and a pressure belt module 62, which form a main part of the fixing device 60*a*. The fixing roll 61 is an example of a fixing member that fixes the toner images on the sheet P. The pressure belt module 62 forms a nip portion (fixing pressure portion) N through which the sheet P holding unfixed images passes, between the fixing roll 61 and the pressure belt module 62.

The fixing roll 61 has a metallic cylindrical core 611 and an elastic layer that is formed of a base layer 612 and a topcoat layer 613, and that is formed on the surface of the metallic cylindrical core 611. In the present exemplary embodiment, the core 611 is made of aluminum, and has an outer diameter of 62 mm, an inner diameter of 55 mm and a length of 350 mm. The base layer 612 is made of HTV silicone rubber, and has a thickness of 2 mm and rubber hardness of Hs 45 JIS A (JIS K 6301). Furthermore, the topcoat layer 613 is made of perfluoroalkylvinylether resin (PFA), and has a thickness of 40 μM. The fixing roll 61 is rotated in a direction of an arrow C at a surface speed of 260 mm/s by a drive unit such as a motor (unillustrated). As the core 611, not only aluminum but also any metallic material may be used as long as the material has high heat conductivity. As for the topcoat layer 613, another material may be used as long as the material is an elastic body with high heat resistance. Here, the rubber hardness is a result of measurement with an A-type hardness meter of a spring type manufactured by TECLOCK Corporation when a load of 1000 gf is applied.

In addition, a halogen heater 63 rated at 1000 W and serving as a heat member that generates heat necessary for fixation is disposed inside the fixing roll 61. The controller 31 (see FIG. 1) of the image forming apparatus 1 regulates the temperature on the surface of the fixing roll 61 so that the temperature keeps at 175 degrees C. on the basis of values measured by a temperature sensor 64. The temperature sensor 64 is provided so as to come into contact with the surface of the fixing roll 61.

A main part of the pressure belt module 62 is formed by a pressure belt 620 and a pressure pad 65. The pressure belt 620 is an example of a fixing pressure member, and is stretched by three rolls of a lead roll 621, a pressure roll 622 and a tension roll 623. The pressure pad 65 is arranged on an inner circumferential surface side of the pressure belt 620 in a state being biased to the fixing roll 61 through the pressure belt 620. The pressure belt module 62 is arranged so as to press the fixing roll 61. Thereby the pressure belt 620 rotates in a direction of an arrow D in accordance with the rotation of the fixing roll 61 in the direction of the arrow C. A movement speed thereof is 260 mm/s, which is the same as the surface speed of the fixing roll 61.

The nip portion N is formed at a contact part between the pressure belt module 62 and the fixing roll 61 by pressure contact of the pressure belt 620 to an outer circumferential surface of the fixing roll 61. At this nip portion N, the pressure pad 65 is arranged inside of the pressure belt 620 in the state being biased toward the fixing roll 61 side through the pressure belt 620. The pressure belt 620 is pressed to the fixing roll 61 by force generated by a compression coil spring 68*a*. Meanwhile, at the most downstream part of the nip portion N, the pressure roll 622 is biased toward the center axis of the fixing roll 61 through the pressure belt 620 by a compression coil spring 68*b*. At this part, local high pressure is generated. This pressing force is 60 kgf.

Specifically, the pressure belt 620 is in pressure contact with the outer circumferential surface of the fixing roll 61 by the pressing force generated by the pressure pad 65 and the pressure roll 622. This forms the nip portion (fixing pressure portion) N through which the sheet P holding unfixed toner images passes, between the fixing roll 61 and the pressure belt 620.

The sheet P holding a toner image is heated and pressured when passing through the nip portion N, and thus the toner image is fixed on the sheet P. At this time, proper gloss is imparted to the toner image on the sheet P by local high pressure with the pressure roll 622 at the most downstream part of the nip portion N.

Here, the pressure belt 620 is an endless belt as an example of a belt member. The pressure belt 620 may be formed of: a base layer; a release layer that covers the surface thereof on the fixing roll 61 side or the both surfaces thereof; and an elastic body layer that is formed between the base layer and the release layer. The base layer is made of resin having high heat resistance. For example, polyimide, polyamide, polyamide-imide or the like is suitable. The base layer is formed so as to have a thickness of, for example, about 50 μm to 125 μm, more preferably 75 μm to 100 μm.

Meanwhile, the release layer may be a layer on which fluororesin, for example, PFA or the like is coated with a thickness of 5 μm to 20 μm. Moreover, the elastic body layer may be made of silicone rubber or the like that has a thickness of 20 μm to 500 μm, preferably 50 μm to 300 μm, and rubber hardness of 8 Hs to 70 Hs (JIS-A), preferably 15 Hs to 30 Hs (JIS-A).

In the fixing device 60*a* of the present exemplary embodiment, the pressure belt 620 is formed of a base layer with an elastic body layer and a release layer laminated on an outer surface side (the fixing roll 61 side) of the base layer. The base layer is made of a polyimide film having a thickness of 75 μm, a width of 340 mm and a circumferential length of 214 mm. The elastic body layer is made of silicone rubber having rubber hardness of 30 Hs (JIS-A) and a thickness of 100 μm. The release layer is made of fluororesin (PFA) having a thickness of 30 μm.

The three rolls stretching the pressure belt 620 are formed of: the lead roll 621 made of stainless steel; the pressure roll 622 covered with, as the elastic body layer, silicone rubber having rubber hardness of 30 Hs (JIS-A) and a thickness of 1.0 mm, on an outer surface of a stainless steel roll; and the tension roll 623 made of stainless steel. The three rolls stretch the pressure belt 620 with tensile strength of 5 kgf. The three rolls have outer diameters of 23 mmϕ, 18 mmϕ and 18 mmϕ, respectively, while having the same length (in the vertical direction with respect to the paper) of 340 mm. Moreover, the lead roll 621 and the tension roll 623 are formed into a so-called crown shape where the outer diameter of a roll is larger in the central portion than in the end portions. This is in order that the displacement of the pressure belt 620 in the axial direction is made as small as possible and that the tensile strength applied to the pressure belt 620 is made uniform in the width direction.

Furthermore, the pressure pad 65 includes an elastic body member for securing a wide nip portion N, and a low friction layer provided on a surface through which the elastic body member is in contact with the inner circumferential surface of the pressure belt 620. The pressure pad 65 is held by a base plate made of metal or the like. The elastic body member having the low friction layer on the surface thereof is formed into a concave almost along the outer circumferential surface of the fixing roll 61, on the fixing roll 61 side. The elastic body member is arranged so as to be pressed against the fixing roll 61, which forms an entering side region of the nip portion N.

The base plate has a width (in the running direction of the pressure belt 620) of 12 mm, a length (in the vertical direction with respect to the paper) of 360 mm and a thickness of 5 mm, and is made of stainless steel.

The elastic body member is made of silicone sponge (silicone rubber foam) with durometer hardness of A23 (JIS K 6253). The width of the elastic body member becomes gradually larger than that of the base plate as the elastic body member is farther from the base plate. Here, the rubber hardness is a result of measurement with an ASKER C-type rubber hardness meter for sponge manufactured by KOBUNSHI KEIKI CO., LTD. when a load of 300 gf is applied. At a part of the pressure pad 65 on the pressure roll 622 side, the elastic body member is formed into a triangle. Such a shape allows the pressure pad 65 to be in contact with the pressure belt 620 through a wider region. Additionally, such a shape allows a low pressure region formed between the pressure pad 65 and the pressure roll 622 to be narrower.

As the elastic body member of the pressure pad 65, a plate spring, an elastic body with high heat resistance such as fluororubber, or the like may be used instead of the above silicone rubber.

The low friction layer formed on the elastic body member is provided in order to reduce sliding resistance between the inner circumferential surface of the pressure belt 620 and the pressure pad 65. Thus, the material of the low friction layer may be one having a low friction coefficient and abrasion resistance. Specifically, a glass fiber sheet impregnated with Teflon (registered trademark), a fluororesin sheet, a fluororesin coating film or the like may be used. In the present exemplary embodiment, the low friction layer is formed of "FGF-400-4" (product name), which is a glass fiber sheet impregnated with polytetrafluoroethylene (PTFE) produced by Chukoh Chemical Industries, Ltd., or a thermosetting polyimide film on which embossing is performed (made uneven), which is formed into a cylinder.

Note that as the pressure pad 65, for example, one formed into a roll may be used instead of one formed into a pad as in the present exemplary embodiment. The pressure pad 65 may be rotated while being biased to the surface of the fixing roll 61 through the pressure belt 620. However, the pressure pad 65 formed into a pad as in the present exemplary embodiment may apply the nip pressure wider and more uniform to all over the nip portion N than that formed into a roll.

The pressure pad 65 is formed so that a radius of curvature for every 5 mm of the contact width gradually becomes smaller like 24 mm, 22 mm and 20 mm from the upstream side in the rotating direction of the pressure belt 620. Here, the load of contact is 34 kgf, and the maximum pressure is about 1.0 kgf/cm$^2$ at 10 mm from the entering side of the nip portion N. A distance of the maximum pressure region from the entering side of the nip portion N and a transporting speed of the sheet P are set so that at this maximum pressure region of the pressure pad 65 the toner is heated, by heat conducted from the fixing roll 61, to a temperature at which the toner viscosity is changed from a glassy state to a state having rubbery fluidity. This generates adhesion between toner particles at the maximum pressure region of the pressure pad 65, which makes movement of the toner particles less easy.

A contact surface through which the low friction layer of the pressure pad 65 is in contact with the pressure belt 620 may fit with the outer circumferential surface of the fixing roll 61, since the elastic body member is provided for the pressure pad 65. Specifically, when the pressure pad 65 is pressed against the fixing roll 61 with a load above a predetermined level, the elastic body member is deformed and thus the contact surface of the low friction layer is deformed into a shape so as to be along with the outer circumferential surface of the fixing roll 61. Therefore, when the pressure pad 65 is pressed against the fixing roll 61 through the pressure belt 620 by the compression coil spring 68*a*, the pressure belt 620 is brought into pressure contact with the fixing roll 61 without any space. Here, the width of the contact surface between the pressure belt 620 and the fixing roll 61 is about 15 mm, and the length of the contact surface in the axial direction is 320 mm.

As mentioned above, the pressure roll 622 arranged at the downstream side in the transporting direction (a direction of an arrow E) of the sheet P with respect to the pressure pad 65 is biased toward the center axis of the fixing roll 61 through the pressure belt 620 by a compression coil spring 68*b*. Thus, at this part, local high pressure is generated. Here, a diameter of the pressure roll 622 may be smaller than that of the fixing roll 61, and a surface of the pressure roll 622 may be formed harder than that of the fixing roll 61. This is for the purpose of efficiently applying the local high pressure against the fixing roll 61 with a small load.

Additionally, on the inner circumferential surface side of the pressure belt 620, the fixing device 60*a* of the present exemplary embodiment includes a lubricant supplying member 66 that supplies lubricant to the inner circumferential surface of the pressure belt 620, and a wiping member 67 that cleans the inner circumferential surface of the pressure belt 620.

In the present exemplary embodiment, the lubricant supplying member 66 is disposed at a position adjacent to the nip portion N and at an entering side of the sheet P, from the perspective of effective reduction of sliding resistance between the pressure pad 65 and the pressure belt 620. More specifically, the lubricant supplying member 66 is arranged on the inner circumferential surface side of the pressure belt 620 between the lead roll 621 and the pressure pad 65. The lubricant supplying member 66 supplies lubricant by applying the lubricant to the inner circumferential surface of the pressure belt 620, while being in contact with the inner circumferential surface of the pressure belt 620. This lubricant makes the pressure belt 620 improved in slidability and abrasion resistance.

As the lubricant supplying member 66, a nonwoven fabric or a felt-like member, which is made of heat-resistant fiber impregnated with lubricant, or a member like an oil roll with a porous fluororesin film wound on a surface of a heat-resistant sponge roll having lubricant therein may be used, for example. Here, lubricant to be used is not particularly limited as long as the lubricant has heat resistance and appropriate viscosity. For example, fluorinated oil, modified fluorinated oil, methylphenyl silicone oil, dimethyl silicone oil, amine-modified silicone oil or the like may be used. However, amine-modified silicone oil is preferable to be used in terms of small viscosity change with respect to temperature change.

Meanwhile, in the present exemplary embodiment, the wiping member 67 is disposed at a position adjacent to the nip portion N on an exit side of the sheet P. More specifically, the wiping member 67 is arranged on the inner circumferential surface side of the pressure belt 620 between the pressure roll 622 and the tension roll 623. The wiping member 67 comes into contact with the inner circumferential surface of the pressure belt 620, and wipes surplus lubricant supplied by the lubricant supplying member 66, abrasive powder generated by abrasion of the pressure belt 620 and the like. Thereby the wiping member 67 cleans the inner circumferential surface of the pressure belt 620. That is, the wiping member 67, together with the lubricant supplying member 66, may be taken as a lubricant adjusting member that supplies an appropriate amount of lubricant on the inner circumferential surface of the pressure belt 620.

A main part of the wiping member 67 is formed by a lubricant absorbing member that is capable of absorbing and holding lubricant such as amine-modified silicone oil.

As the lubricant absorbing member, a felt (nonwoven fabric), a Gore-Tex (registered trademark) membrane made of a PTFE nonwoven fabric having a low friction coefficient, porously formed fluororesin or the like may be used, for example. Here, fluororesin such as PTFE resin that is made porous through a stretch molding in a uniaxial or biaxial direction or a sinter molding may be used as the porously formed fluororesin. Additionally, a configuration of this fluororesin may be selected among one formed by laminating film-shaped fluororesin, fabric-shaped one, one obtained by bonding a film and a fabric, and the like.

Figure 3A:
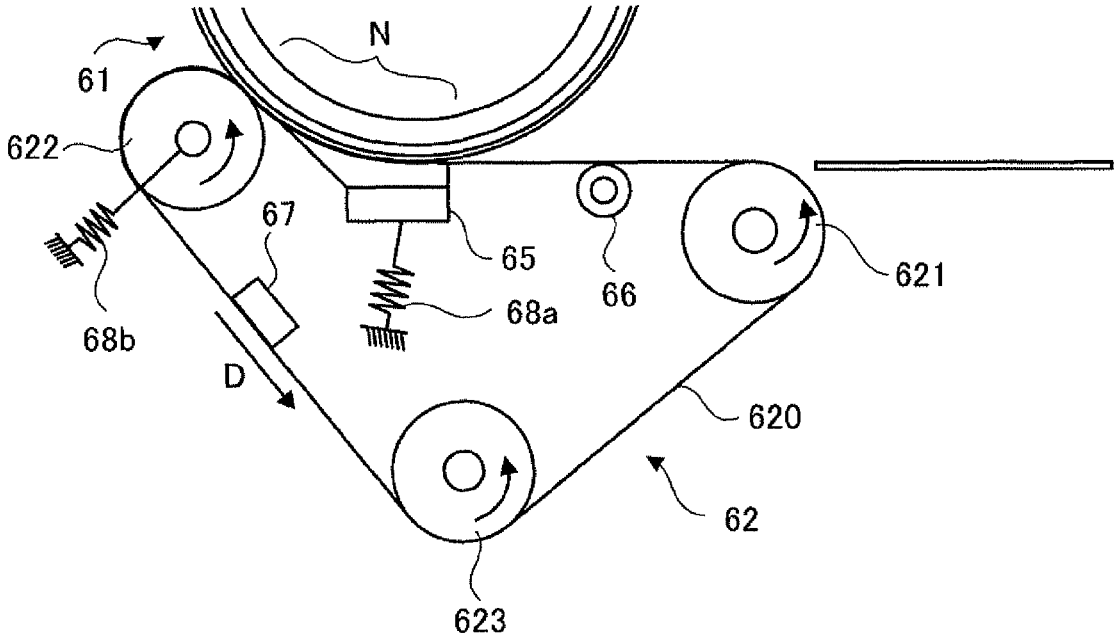
FIGS. 3A and 3B are diagrams illustrating a contacting state and a separated state between the lubricant supplying member and the wiping member, and the inner circumferential surface of the pressure belt.
Figure 3B:
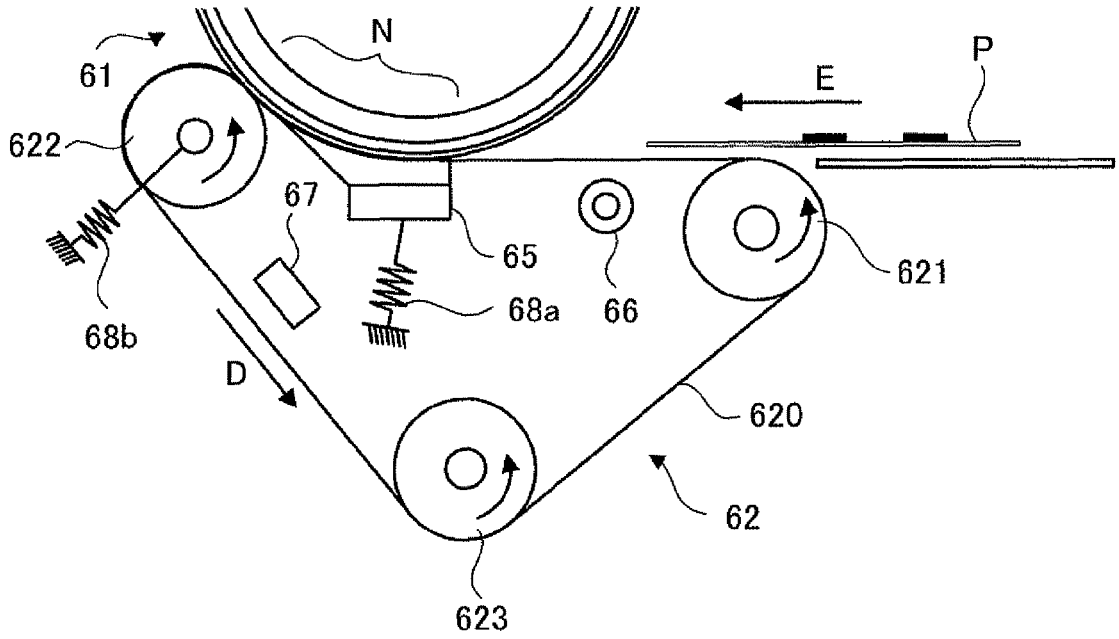

Although detailed descriptions will be given later, the lubricant supplying member 66 and the wiping member 67 are allowed to switch a state thereof between a contacting state to the inner circumferential surface of the pressure belt 620 and a separated state therefrom by the controller 31 (see FIG. 1) and an unillustrated driving mechanism, as shown in FIGS. 3A and 3B. In the contacting state (FIG. 3A), the lubricant supplying member 66 supplies lubricant to the inner circumferential surface of the pressure belt 620. The wiping member 67 cleans the pressure belt 620 by wiping the inner circumferential surface thereof. Meanwhile, in the separated state (FIG. 3B), the lubricant supplying member 66 stops supplying lubricant to the inner circumferential surface of the pressure belt 620. The wiping member 67 stops wiping the inner circumferential surface of the pressure belt 620.

Next, fixing operations in the fixing device 60*a* of the present exemplary embodiment will be described.

The sheet P, onto which an unfixed toner image has been electrostatically transferred in the secondary transfer portion T (see FIG. 1) of the image forming apparatus 1, transported toward the nip portion N of the fixing device 60*a* (in the direction of the arrow E). The unfixed toner image on the surface of the sheet P passing through the nip portion N is fixed on the sheet P by pressure and heat acting on the nip portion N. As described above, the fixing device 60*a* of the present exemplary embodiment employs a configuration in which the fixing roll 61 and the pressure belt 620 are in contact with each other while the pressure pad 65 is pressed thereto. This allows the nip portion N to be set wider and thus stable fixing performance to be secured.

In the fixing device 60*a* of the present exemplary embodiment, a toner image is fixed on an ideal level by pressure and heat applied at the nip portion N. At the most downstream part of the nip portion N, the pressure roll 622 that is arranged in the state being biased toward the center axis of the fixing roll 61 efficiently presses the melted toner image with local high pressure. This secures fixing properties and smoothes the surface of the toner image so as to impart image gloss of high quality to the color image. As described above, the diameter of the pressure roll 622 is smaller than that of the fixing roll 61, and the surface of the pressure roll 622 is formed harder than that of the fixing roll 61. This allows the pressure roll 622 to apply local high pressure to the toner image efficiently with a small load.

The following problem may occur if the lubricant supplying member 66 and the wiping member 67 are brought into contact with the inner circumferential surface of the pressure belt 620 during the operation of such a fixing device.

First, pressure caused by contact of the lubricant supplying member 66 generates friction resistance between the lubricant supplying member 66 and the pressure belt 620. This friction resistance may slow a rotational speed of the pressure belt 620 since the friction resistance resists the rotation thereof in some cases. That is, speed fluctuation of the pressure belt 620 is generated. This may cause a non-uniform fixing image and fast abrasion of the surface of the pressure belt 620.

Additionally, surplus lubricant may be supplied by the lubricant supplying member 66. In such a case, the surplus lubricant may swell the base layer 612 and the topcoat layer 613 that are the elastic body layer of the contacting fixing roll 61, and the lubricant may attach to the sheet P under transportation. Even in this case, this problem hardly occurs for an oil-supply type image forming apparatus in which oil is included in a toner and supplied on the surface of the fixing roll 61 in order to peel the sheet P from the fixing roll 61. Specifically, the elastic body layer is hardly swelled by the lubricant, since the material and the configuration of the fixing roll 61 are resistant to a swell by the lubricant. However, there have been many image forming apparatuses of a type using a toner without oil and the like, a so-called oilless toner, in recent years. In this case, the above problem is likely to occur.

Accordingly, in the present exemplary embodiment, the lubricant supplying member 66 and the wiping member 67 are separated from the inner circumferential surface of the pressure belt 620 while the sheet P and the pressure belt 620 are in contact with each other. The lubricant supplying member 66 and the wiping member 67 do not come into contact with the pressure belt 620 while the sheet P and the pressure belt 620 are in contact with each other. Thus, the lubricant supplying member 66 and the wiping member 67 do not resist the rotation of the pressure belt 620. Additionally, the lubricant supplying member 66 is in contact with the inner circumferential surface of the pressure belt 620 until immediately before the sheet P is brought into contact with the pressure belt 620. This allows a sufficient amount of the lubricant to be supplied. Therefore, since a proper amount of the lubricant remains even during the fixing operations, slidability of the pressure belt 620 is less likely to reduce.

Additionally, in the present exemplary embodiment, the lubricant supplying member 66 and the wiping member 67 are separated from the inner circumferential surface of the pressure belt 620 without being in contact therewith, while the pressure belt 620 does not rotate, that is, while the rotation is stopped.

If the lubricant supplying member 66 and the wiping member 67 are brought into contact with the pressure belt 620 while the pressure belt 620 does not rotate, the pressure of contact is likely to give permanent deformation to the pressure belt 620. Especially when a resin base material with heat resistance is used for the base layer of the pressure belt 620, this permanent deformation is easily generated. If permanent deformation is generated, the deformation remains in the pressure belt 620 at the time of the next fixing operations (immediately after the start, in particular). Thus, the sheet P is likely to flap while passing through the nip portion N. As a result, a trouble such as a bend of a sheet tip or wrinkles on a sheet easily occurs. Additionally, the toner image on the sheet P is likely to come into contact with the fixing roll 61 and the like before the nip portion N. As a result, a phenomenon called smudge with the fixing image being non-uniform easily occurs.

When the pressure belt 620 does not rotate, only a contact portion between the lubricant supplying member 66 and the pressure belt 620 is supplied with the lubricant by the lubricant supplying member 66, which leads to excessive supply to only a part of the pressure belt 620. Thus, surplus lubricant is likely to protrude from the inner circumferential surface of the pressure belt 620 at the time of the next fixing operations. As a result, the swell of the fixing roll 61 and the attachment of the lubricant to the sheet P easily occur. Therefore, the lubricant supplying member 66 and the wiping member 67 should not be in contact with the inner circumferential surface of the pressure belt 620, while the pressure belt 620 does not rotate.

Note that the contact and separation between each of the lubricant supplying member 66 and the wiping member 67, and the inner circumferential surface of the pressure belt 620 may be controlled by the controller 31 (see FIG. 1).

Specifically, a time period during rotation before and after the sheet P passes through, a time period during processing of image information by a processing circuit in the image forming apparatus 1, a time period during adjustment of a device in the image forming apparatus 1 (see FIG. 1) except the fixing device 60*a*, and the like are listed as examples of a state where the pressure belt 620 rotates and is not in contact with the sheet P.

Some types of fixing device may include a moving mechanism that is capable of switching a state of the pressure belt module 62 and the fixing roll 61 from a contacting state shown in FIG. 2 to a separated state.

Figure 4A:
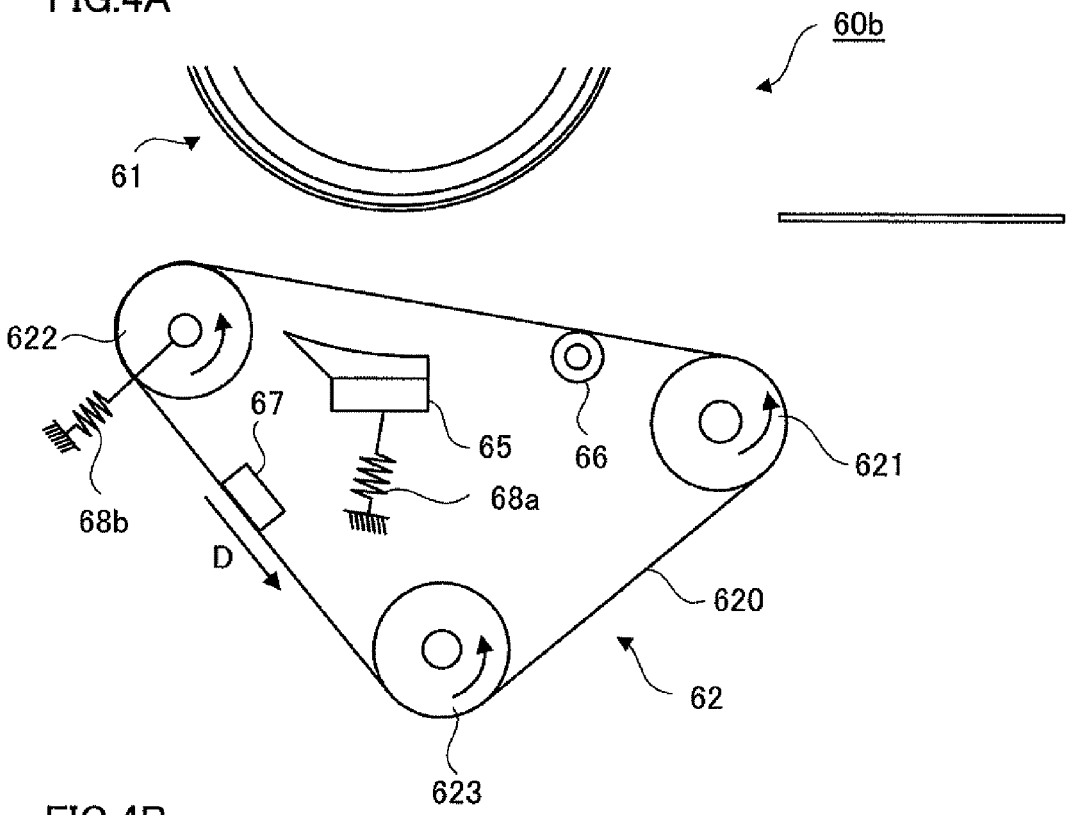
FIGS. 4A and 4B are diagrams illustrating a fixing device having a moving mechanism.
Figure 4B:
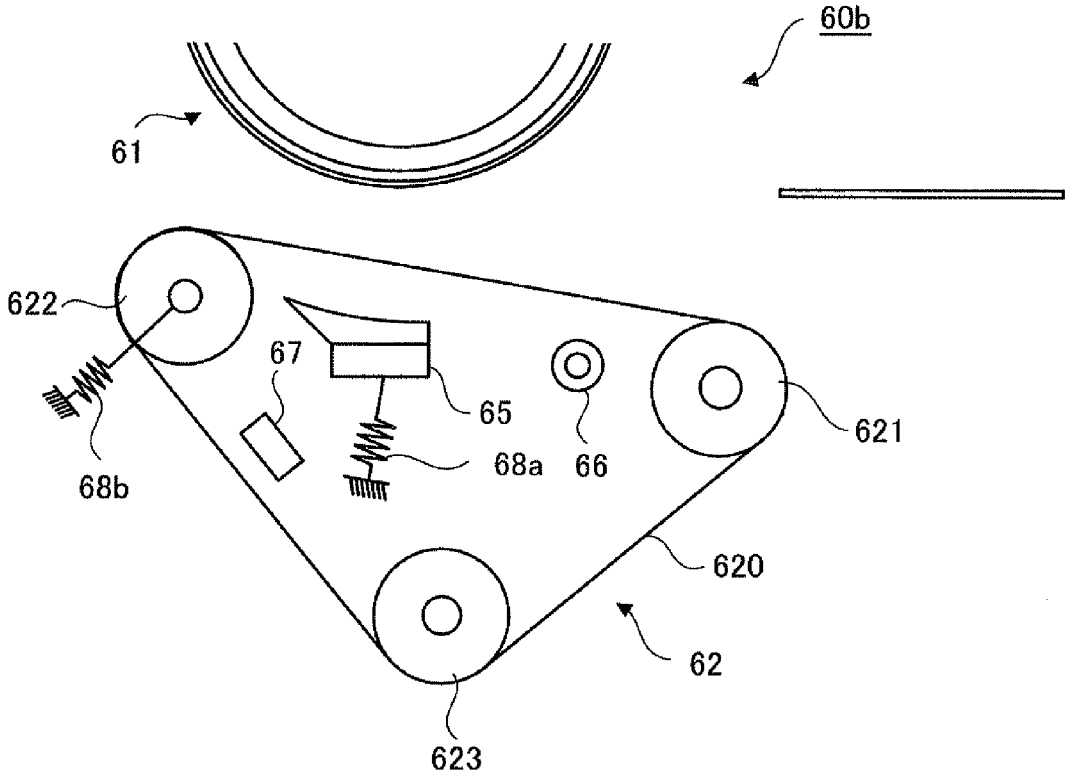

FIGS. 4A and 4B are diagrams illustrating a fixing device having a moving mechanism. A fixing device 60*b* shown in FIGS. 4A and 4B is a second exemplary embodiment of the fixing device in the exemplary embodiments, and a second example of the fixing device 60 shown in FIG. 1. A basic configuration of the fixing device 60*b* is the same as that of the fixing device 60*a* shown in FIG. 2. However, the pressure belt module 62 and the fixing roll 61 are allowed to switch a state thereof between the contacting state (shown in FIG. 2) and a separated state (shown in FIGS. 4A and 4B) by an unillustrated moving mechanism. This control may be performed by the controller 31 (see FIG. 1).

In such a fixing device 60*b*, setting in the separated state shown in FIGS. 4A and 4B may cause the nip portion N not to be formed, when the fixing operations are not performed. Thus, occurrence of irrecoverable deformation in the elastic body layer of the fixing roll 61 and permanent deformation in the pressure belt 620 of the pressure belt module 62 may be suppressed.

In the present exemplary embodiment, when the pressure belt module 62 and the fixing roll 61 are in the separated state, the lubricant supplying member 66 and the wiping member 67 are brought into contact with the inner circumferential surface of the pressure belt 620 during the rotation of the pressure belt 620 as shown in FIG. 4A. Meanwhile, the lubricant supplying member 66 and the wiping member 67 are separated from the inner circumferential surface of the pressure belt 620 while the rotation of the pressure belt 620 is stopped as shown in FIG. 48. Although at the time of the next fixing operations, the pressure belt module 62 and the fixing roll 61 become in the contacting state, this configuration may give stable supply of the lubricant to the pressure belt 620. Specifically, a predetermined amount of the lubricant may be held on the inner circumferential surface of the pressure belt 620 at the time of the next fixing operations. This may cause the pressure belt 620 to stably rotate, and suppress abrasion of the inner circumferential surface of the pressure belt 620 and the like and unevenness in rotation of the pressure belt 620.

Although both the lubricant supplying member 66 and the wiping member 67 are provided in the above described fixing devices 60*a* and 60*b*, the exemplary embodiments are not limited to this case but are also applicable to a fixing device that includes either the lubricant supplying member 66 or the wiping member 67.

If both the lubricant supplying member 66 and the wiping member 67 are provided as in the above described fixing devices 60*a* and 60*b*, the lubricant supplying member 66 may be brought into contact with the inner circumferential surface of the pressure belt 620 after the wiping member 67 is brought into contact therewith. Specifically, first the wiping member 67 cleans the inner circumferential surface of the pressure belt 620, and then the lubricant supplying member 66 supplies the lubricant. This makes application of the lubricant on the inner circumferential surface of the pressure belt 620 more uniform. Note that this control may also be performed by the controller 31 (see FIG. 1).

Although in the above described fixing devices 60*a* and 60*b*, the fixing roll 61 and the pressure belt module 62 form a main part thereof, the exemplary embodiments are not limited to this case.

Figure 5:
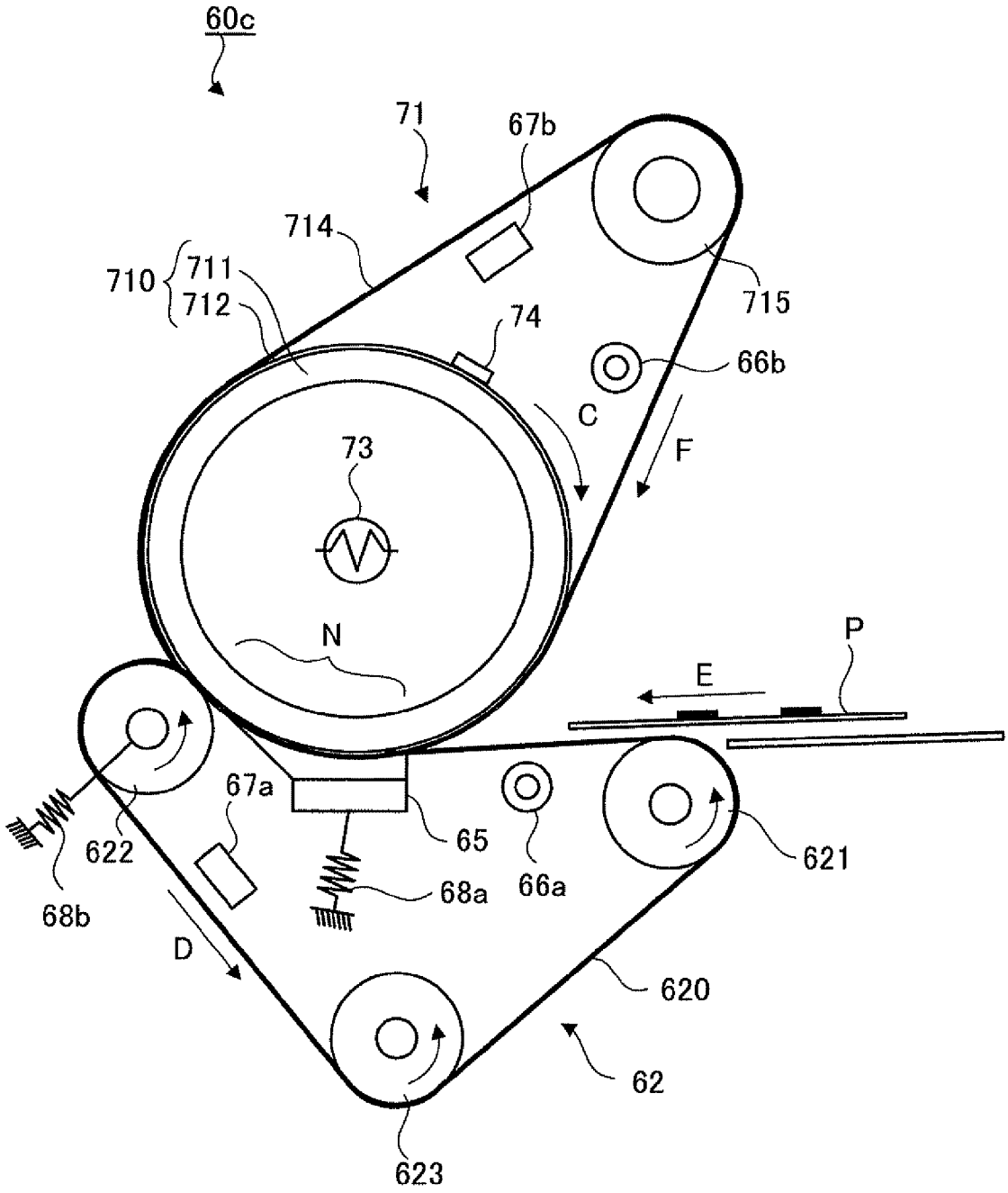
FIG. 5 is a diagram illustrating a third exemplary embodiment of the fixing device in the exemplary embodiments.

FIG. 5 is a diagram illustrating a third exemplary embodiment of the fixing device in the exemplary embodiments.

A fixing device 60*c* shown in FIG. 5 is a third example of the fixing device 60 shown in FIG. 1. The fixing device 60*c* includes a fixing belt module 71 and the pressure belt module 62, which form a main part of the fixing device 60*c*. The pressure belt module 62 forms a nip portion (fixing pressure portion) N through which the sheet P holding unfixed images passes, between the fixing belt module 71 and the pressure belt module 62.

Since the configuration of the pressure belt module 62 is the same as that in the fixing device 60*a* shown in FIG. 2, the detailed descriptions thereof are omitted herein.

The fixing belt module 71 includes a fixing roll 710, a tension roll 715 and a fixing belt 714, which form a main part of the fixing belt module 71. The fixing roll 710 rotates in the direction of the arrow C. Inside the tension roll 715, a halogen heater 73 serving as the heat member is disposed. The fixing belt 714, as an example of the fixing member, is stretched by the fixing roll 710 and the tension roll 715, and rotates in a direction of an arrow F in accordance with the rotation of the fixing roll 710 in the direction of the arrow C.

The fixing roll 710 is formed of: a core 711 made of aluminum having a thickness of 5 mm; and an elastic body layer 712 covering a surface of the core 711 and having a thickness of 1.5 mm. The fixing roll 710 is a soft roll having an outer diameter of 65 ramp and a length of 350 mm. Liquid silicone rubber (LSR) having rubber hardness of 25 Hs to 45 Hs (JIS-A) is used for the elastic body layer 712. The fixing roll 710 rotates in the direction of the arrow C at a surface speed of 260 mm/s.

In addition, the halogen heater 73 rated at 1000 W and serving as the heat member is disposed inside of the fixing roll 710. The controller 31 (see FIG. 1) of the image forming apparatus 1 regulates the temperature on the surface of the fixing roll 710 so that the temperature keeps at 175 degrees C. on the basis of values measured by a temperature sensor 74. The temperature sensor 74 is provided so as to come into contact with the surface of the fixing roll 710.

The material of the elastic body layer 712 is not limited to silicone rubber. Various kinds of conventionally known materials such as fluororubber may be used, for example. Alternatively, the elastic body layer 712 obtained by laminating multiple layers made of silicone rubber and fluororubber may be used. Moreover, a so-called hard roll without the elastic body layer 712 may be used for the fixing roll 710. In this case, heat supply from the fixing roll 710 to the fixing belt 714 is made more efficient, and the fixing device 60*c* having excellent fast speed properties with a small temperature loop is obtained.

The fixing belt 714 is stretched by the fixing roll 710 and the tension roll 715 with tensile strength of 5 kgf. The fixing belt 714 is formed of an endless belt, serving as the belt member, having a circumferential length of 330 mm and a width of 340 mm.

The fixing belt 714 has the following multilayer structure. The fixing belt 714 includes: a base layer made of polyimide resin having a thickness of 75 μm; an elastic body layer laminated on a front surface side (an outer circumferential surface side) of the base layer, and made of silicone rubber having a thickness of 200 μm. Furthermore, as a release layer, the fixing belt 714 includes a surface layer that is made of tetrafluoroethylene-perfluoroalkyl vinylether copolymer resin (PFA) having a thickness of 30 μm, on the elastic body layer. The elastic body layer here is provided in order to enhance image quality of a color image, in particular. In the present exemplary embodiment, silicone rubber having rubber hardness of 20 Hs (JIS-A) is used for the elastic body layer. Note that, compositions of the fixing belt 714 such as materials, thicknesses, and levels of hardness may be selected according to apparatus design conditions such as a purpose of use and conditions of use.

The tension roll 715 is formed of a stainless pipe roll having an outer diameter of 23 mmϕ, a thickness of 2 mm and a length of 350 mm.

Moreover, the tension roll 715 is formed into a so-called crown shape where the outer diameter of a roll is larger by 100 μM in the central portion than in the end portions. This is in order that the displacement of the fixing belt 714 in the axial direction is made as small as possible and that the tensile strength applied to the fixing belt 714 is made uniform in the width direction.

Additionally, on the inner circumferential surface side of the fixing belt 714, the fixing device 60*c* includes a lubricant supplying member 66*b* that supplies lubricant to the inner circumferential surface of the fixing belt 714, and a wiping member 67*b* that cleans the inner circumferential surface of the fixing belt 714.

In the present exemplary embodiment, the lubricant supplying member 66*b* is arranged at the upstream side of the fixing roll 710 on the inner circumferential surface side of the fixing belt 714, from the perspective of effective reduction of sliding resistance between the fixing roll 710 and the fixing belt 714. The lubricant supplying member 66*b* supplies lubricant by applying the lubricant to the inner circumferential surface of the fixing belt 714, while being in contact with the inner circumferential surface of the fixing belt 714.

Meanwhile, in the present exemplary embodiment, the wiping member 67*b* is arranged at the downstream side of the fixing roll 710 on the inner circumferential surface side of the fixing belt 714. The wiping member 67*b* comes into contact with the inner circumferential surface of the fixing belt 714, and wipes surplus lubricant supplied by the lubricant supplying member 66*b*, abrasive powder generated by abrasion of the fixing belt 714 and the like. Thereby the wiping member 67*b* cleans the inner circumferential surface of the fixing belt 714.

At a contact part between the pressure belt module 62 and the fixing belt module 71 of the fixing device 60*c* having the above configuration, the nip portion N is formed in a region where the fixing belt 714 is wound (wrapped) around the fixing roll 710 so that the pressure belt 620 is in pressure contact with the outer circumferential surface of the fixing belt 714. At this nip portion N, the pressure pad 65 is arranged inside of the pressure belt 620 in the state being biased toward the fixing roll 710 side through the pressure belt 620, and presses the pressure belt 620 to the wrapped region of the fixing roll 710. Meanwhile, at the most downstream part of the nip portion N, the pressure roll 622 is biased toward the center axis of the fixing roll 710 through the pressure belt 620 and the fixing belt 714 by the compression coil spring 68*b* serving as a pressure unit. At a contact part between the fixing roll 710 and the fixing belt 714, local high pressure is generated.

The sheet P holding a toner image is heated and pressured when passing through this nip portion N, and thus the toner image is fixed on the sheet P.

The operations of the lubricant supplying members 66*a* and 66*b*, and the wiping members 67*a* and 67*b* are the same as those in the fixing device 60*a* mentioned above. Specifically, the lubricant supplying members 66*a* and 66*b*, and the wiping members 67*a* and 67*b* are separated from the inner circumferential surface of the pressure belt 620, at least while the sheet P and each of the pressure belt 620 and the fixing belt 714 are in contact with each other. Meanwhile, the lubricant supplying members 66*a* and 66*b*, and the wiping members 67*a* and 67*b* are separated from the inner circumferential surface of the fixing belt 714 and the pressure belt 620, while the rotation of the fixing belt 714 and the pressure belt 620 is stopped.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing member that fixes a toner image on a recording medium;

a fixing pressure member that forms, between the fixing member and the fixing pressure member, a fixing pressure portion for the recording medium holding an unfixed toner image to pass through, by being brought into pressure contact with an outer circumferential surface of the fixing member;

a drive unit that rotates the fixing pressure member by rotating the fixing member; and a lubricant adjusting member that comes into contact with an inner circumferential surface of a belt member, at least any one of the fixing member and the fixing pressure member being the belt member, wherein the lubricant adjusting member is separated from the inner circumferential surface of the belt member, at least while the recording medium and the belt member are in contact with each other and while the belt member is rotated, and the lubricant adjusting member is separated from the inner circumferential surface of the belt member while rotation of the belt member is stopped.

2. The fixing device according to claim 1, wherein the lubricant adjusting member is at least any one of a lubricant supplying member that supplies lubricant to the inner circumferential surface of the belt member, and a wiping member that wipes the inner circumferential surface of the belt member.

3. The fixing device according to claim 2, wherein the lubricant supplying member is disposed at a position adjacent to the fixing pressure portion and at an entering side of the recording medium.

4. The fixing device according to claim 2, wherein the lubricant supplying member is a member selected among a member formed of any one of a nonwoven fabric and a felt that are made of heat-resistant fiber impregnated with lubricant, and a member like an oil roll with a porous fluororesin film wound on a surface of a heat-resistant sponge roll having lubricant inside of the sponge roll.

5. The fixing device according to claim 2, wherein the wiping member is disposed at a position adjacent to the fixing pressure portion and at an exit side of the recording medium.

6. The fixing device according to claim 2, wherein the wiping member is made of any one of a felt (nonwoven fabric), a membrane made of a PTFE nonwoven fabric having a low friction coefficient, and porously formed fluororesin.

7. The fixing device according to claim 1, further comprising a moving mechanism that is capable of switching a state of the fixing member and the fixing pressure member between a contacting state and a separated state.

8. An image forming apparatus comprising:

a toner image forming unit that forms a toner image;

a transfer unit that transfers, onto a recording medium, the toner image formed by the toner image forming unit;

a fixing unit including:

a fixing member that fixes the toner image on the recording medium;

a fixing pressure member that forms, between the fixing member and the fixing pressure member, a fixing pressure portion for the recording medium holding an unfixed toner image to pass through, by being brought into pressure contact with an outer circumferential surface of the fixing member;

a drive unit that rotates the fixing member by rotating the fixing pressure member; and a lubricant adjusting member that comes into contact with an inner circumferential surface of a belt member, at least anyone of the fixing member and the fixing pressure member being the belt member; and a controller that controls the lubricant adjusting member so as to be separated from the inner circumferential surface of the belt member, at least while the recording medium and the belt member are in contact with each other and while the belt member is rotated, and that control the lubricant adjusting member so as to be separated from the inner circumferential surface of the belt member while rotation of the belt member is stopped.

9. The image forming apparatus according to claim 8, wherein the lubricant adjusting member is at least any one of a lubricant supplying member that supplies lubricant to the inner circumferential surface of the belt member, and a wiping member that wipes the inner circumferential surface of the belt member.

10. The image forming apparatus according to claim 9, wherein the lubricant supplying member is a member selected among a member formed of any one of a nonwoven fabric and a felt that are made of heat-resistant fiber impregnated with lubricant, and a member like an oil roll with a porous fluororesin film wound on a surface of a heat-resistant sponge roll having lubricant inside of the sponge roll.

11. The image forming apparatus according to claim 9, wherein the wiping member is made of any one of a felt (nonwoven fabric), a membrane made of a PTFE nonwoven fabric having a low friction coefficient, and porously formed fluororesin.

12. The image forming apparatus according to claim 8, further comprising:

a lubricant supplying member that supplies lubricant to the inner circumferential surface of the belt member; and a wiping member that wipes the inner circumferential surface of the belt member, wherein the controller further controls the lubricant supplying member so as to cause the lubricant supplying member to be brought into contact with the inner circumferential surface of the belt member after causing the wiping member to come into contact with the inner circumferential surface of the belt member.

13. The image forming apparatus according to claim 8, further comprising a moving mechanism that is capable of switching a state of the fixing member and the fixing pressure member between a contacting state and a separated state, wherein the controller further controls the fixing member and the fixing pressure member to be in the contacting state at least when the recording medium passes.

14. A method of controlling a fixing device including: a fixing member that fixes a toner image on a recording medium; a fixing pressure member that forms, between the fixing member and the fixing pressure member, a fixing pressure portion for the recording medium holding an unfixed toner image to pass through, by being brought into pressure contact with an outer circumferential surface of the fixing member; a drive unit that rotates the fixing pressure member by rotating the fixing member; and a lubricant adjusting member that comes into contact with an inner circumferential surface of a belt member, at least any one of the fixing member and the fixing pressure member being the belt member; the method comprising:

controlling the lubricant adjusting member to be separated from the inner circumferential surface of the belt member while the recording medium and the belt member are in contact with each other; and controlling the lubricant adjusting member to be separated from the inner circumferential surface of the belt member while rotation of the belt member is stopped.

* * * * *